US011849300B2

(12) United States Patent
Armstrong

(10) Patent No.: US 11,849,300 B2
(45) Date of Patent: Dec. 19, 2023

(54) TRANSFER FUNCTION MODIFICATION SYSTEM AND METHOD

(71) Applicant: Sony Interactive Entertainment Inc., Tokyo (JP)

(72) Inventor: Calum Armstrong, London (GB)

(73) Assignee: Sony Interactive Entertainment Inc., Tokyo (JP)

( * ) Notice: Subject to any disclaimer, the term of this patent is extended or adjusted under 35 U.S.C. 154(b) by 0 days.

(21) Appl. No.: 17/587,249

(22) Filed: Jan. 28, 2022

(65) Prior Publication Data

US 2022/0256300 A1 Aug. 11, 2022

(30) Foreign Application Priority Data

Feb. 11, 2021 (GB) ..... 2101887

(51) Int. Cl.
*H04S 1/00* (2006.01)
*H04S 7/00* (2006.01)

(52) U.S. Cl.
CPC ..... *H04S 1/002* (2013.01); *H04S 1/007* (2013.01); *H04S 7/301* (2013.01); *H04S 2400/01* (2013.01); *H04S 2400/13* (2013.01); *H04S 2420/01* (2013.01)

(58) Field of Classification Search
None
See application file for complete search history.

(56) References Cited

U.S. PATENT DOCUMENTS 5,659,619 A 8/1997 Abel
11,115,773 B1 * 9/2021 Satongar ..... H04R 5/04
2008/0056503 A1 3/2008 McGrath

OTHER PUBLICATIONS

Combined Search and Examination Report for corresponding GB Application No. GB2101887.4, 12 pages, dated Oct. 22, 2021.
Extended European Search Report for corresponding EP Application No. 22153656.8, 9 pages, dated Jul. 1, 2022.

* cited by examiner

*Primary Examiner* — Kenny H Truong
(74) *Attorney, Agent, or Firm* — Matthew B. Dernier, Esq.

(57) ABSTRACT

A head-related transfer function, HRTF, dataset modification system, the system including an HRTF identifying unit operable to identify a first HRTF from an HRTF dataset, a filter generating unit operable to generate a filter in dependence upon the first HRTF, and an HRTF modification unit operable to modify the first HRTF by applying the generated filter to generate an output HRTF, where the generating comprises the steps of: identifying a spectral response of the first HRTF, identifying a plurality of second HRTFs within the HRTF dataset, each within a predetermined distance of the first HRTF, and a spectral response associated with each of the second HRTFs, generating an average of each of the identified spectral responses of the first and second HRTFs, and generating a filter using the inverse of this average.

15 Claims, 7 Drawing Sheets

TRANSFER FUNCTION MODIFICATION SYSTEM AND METHOD

BACKGROUND OF THE INVENTION

Field of the Invention

This disclosure relates to a transfer function modification system and method.

Description of the Prior Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

An important feature of human hearing is that of the ability to localise sounds in the environment. Despite having only two ears, humans are able to locate the source of a sound in three dimensions; the interaural time difference and interaural intensity variations for a sound (that is, the time difference between receiving the sound at each ear, and the difference in perceived volume at each ear) are used to assist with this, as well as an interpretation of the frequencies of received sounds.

As the interest in immersive video content increases, such as that displayed using virtual reality (VR) headsets, the desire for immersive audio also increases. Immersive audio should sound as if it is being emitted by the correct source in an environment, that is the audio should appear to be coming from the location of the virtual object that is intended as the source of the audio; if this is not the case, then the user may lose a sense of immersion during the viewing of VR content or the like. While surround sound speaker systems have been somewhat successful in providing audio that is immersive, the provision of a surround sound system is often impractical.

In order to perform correct localisation for recorded sounds, it is necessary to perform processing on the signal so as to generate the expected interaural time difference and the like for a listener. In previously proposed arrangements, so-called head-related transfer functions (HRTFs) have been used to generate a sound that is adapted for improved localisation. In general, an HRTF is a transfer function that is provided for each of a listener's ears and for a particular location in the environment relative to the listener's ears.

In general, a discrete set of HRTFs is provided (as an HRTF dataset) for a listener and environment such that sounds can be reproduced correctly for a number of different positions in the environment relative to the listener's head position. However, one shortcoming of this method is that there are a number of positions in the environment for which no HRTF is defined. Earlier methods, such as vector base amplitude panning (VBAP), have been used to mitigate these problems.

In addition to this, HRTFs are often not sufficient for their intended purpose; the required HRTFs differ from listener to listener, and so a generalised HRTF is unlikely to be suitable for a group of listeners. For example, a listener with a larger head may expect a greater interaural time difference than a listener with a smaller head when hearing a sound from the same relative position. In view of this, the HRTFs may also have different spatial dependencies for different listeners. The measuring of an HRTF can also be time consuming, expensive, and also suffer from distortions due to objects (such as the equipment in the room) in the HRTF measuring environment and/or a non-optimal positioning of the listener within the HRTF measuring environment. This can lead to an unsatisfactory audio reproduction when using the HRTF to generate an audio output.

It is therefore apparent that there are numerous problems associated with generating and utilising suitable HRTFs for a particular application. It is in the context of these problems that the present disclosure arises.

SUMMARY OF THE INVENTION

This disclosure is defined by claim 1.

Further respective aspects and features of the disclosure are defined in the appended claims.

It is to be understood that both the foregoing general description of the invention and the following detailed description are exemplary, but are not restrictive, of the invention.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE EMBODIMENTS

Figure 1:
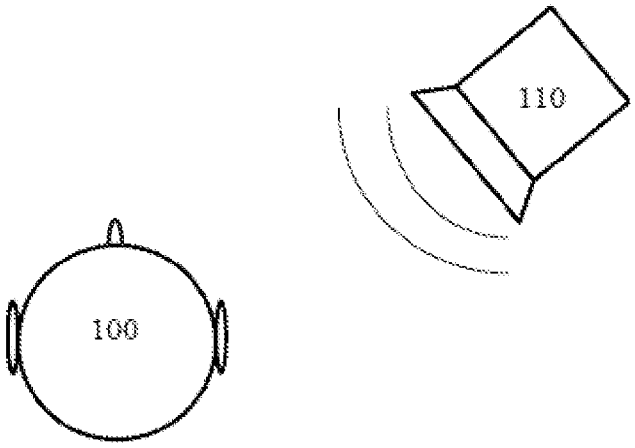
FIG. 1 schematically illustrates a listener and a sound source location.

Referring now to the drawings, wherein like reference numerals designate identical or corresponding parts throughout the several views, embodiments of the present disclosure are described.

As discussed above head-related transfer functions (HRTFs) are used to generate an improved audio output for a listener, in particular with respect to localisation of sounds within the audio. HRTFs contain information such as time delay, level difference, and spectral response for audio generated with a particular location relative to a listener in a virtual environment. The HRTF is combined with a raw sound source (such as audio from a game or video) in order to generate output audio.

The time delay information within an HRTF is indicative of the time taken for a sound to propagate from the sound source to the listener (this may also be referred to as time-of-arrival). In the case of an HRTF being provided for each of the listener's ears, this can lead to the definition of an interaural time delay (that is, the time delay between each ear receiving the sound) which may be a useful indication of the sound source direction for the listener.

The interaural level difference for HRTFs is indicative of the difference in amplitude of a sound signal as received at each of the listener's ears. That is to say that the interaural level difference defines the difference in how loud a sound will appear to each of the ears—this difference is dependent upon the location of the sound source. For instance, a sound source directly in front of a listener will have a low interaural level difference (as the sound will be equally audible to each ear), while a sound source to the right of a listener will be louder in the right ear than the left ear.

The spectral response as defined by the HRTF identifies the relationship between the magnitude of the response (effectively a measure of the loudness of the sound) at the listener's ear and the frequency of a sound. This response is defined for each of a number of different locations relative to the listener—these locations are generally defined based upon the azimuthal and elevation angles. The spectral response is therefore an indication of how different frequencies are interpreted by the listener in dependence upon the relative direction of the sound source.

HRTFs are unique to each listener, as due to a number of different factors (such as head size and ear shape/size) each listener may interpret incoming sounds differently. For instance, a listener with a larger head may have a greater interaural level difference. In many cases, however, it is considered that a single HRTF may be sufficiently accurate for use by a group of listeners despite the differences. That is to say that an HRTF may be used to generate sufficiently accurate audio for a group of listeners (such as those with a similar head size) so as to enable each listener to use the same HRTF. This may be advantageous in that a small selection of pre-generated HRTFs may be provided to a listener for selection rather than requiring a personalised one to be generated.

An HRTF may be selected for a listener based upon a measurement of one or more of these physical characteristics in some embodiments, or an input by a listener identifying such measurements. In some embodiments, the HRTF selection process may be based upon a calibration process that is provided to a listener in which audio is generated using a variety of different HRTFs and the HRTF leading to the most accurate sound localisation (as indicated by listener input) is selected. Alternatively, an HRTF may be generated for a specific listener using a recording method, or a listener may select an HRTF from an available selection based upon which appears to be a closest fit (i.e. which HRTF, when used, leads to the generation of the most accurate audio reproduction for that listener).

As a result of the selection of a desired HRTF by a listener, audio with particular characteristics is reproduced throughout the listener experience. Some of these characteristics may be influenced by the HRTF properties without being specifically defined in the HRTF; an example of such a characteristic is that of timbre. Timbre, also known as tone colour or tone quality, relates to characteristic qualities of a sound. This can lead to two sounds with the same frequency and loudness sounding different to a listener—for instance, the same key pressed on two different pianos may sound different even if both are well-tuned to the same note.

The timbre that is identified by a listener is dependent upon the relative position of the sound source to the listener; the timbre that a listener associates with a sound source therefore has an angular dependence. This may be a result of a number of factors, such as body shadowing when the sound source is located below the listener; this can lead to a large reduction in the amplitude of high frequencies in particular, thereby distorting the sound as heard by the listener. IT is considered advantageous in a number of cases that control of the timbre resulting from the use of a particular HRTF is able to be performed, for example so as to modify the effect of the timbre on the listener by modifying the HRTFs.

One motivation for performing such control may be that of improving the accuracy of the HRTFs that are used to generate output audio for a listener. Alternatively, or in addition, it may be considered that modifications to HRTFs are made so as to increase the sense of immersion experienced by a listener or to otherwise improve the listener experience; in some cases, this may not necessarily correspond to generating the most accurate representation of timbre. For instance a reproduction of the body shadowing effect described above may be considered to be accurate, and yet jarring to a listener that may not expect the effect to be so noticeable. Such modifications may therefore improve the perceived quality of output audio generated using the HRTFs.

The spectral response of an HRTF can be considered to comprise two sets of features, each of which can have a significant effect on the timbre of output audio. The first of these sets of features is that of pinnae notches; these are represented by sharp peaks in the spectral response, indicating a significant change in the response magnitude over a small frequency range. Such notches are a primary source of localisation information within an HRTF for a listener, and as such the locations of these notches (and their magnitude) may be considered to be significant. The second of these sets of features is that of more general variations within the spectral response; these more gradual variations, such as general high-frequency boosts or cuts, have a smaller contribution to the perceived location of a sound source but can still have a significant effect on the timbre associated with a sound.

In embodiments of the present disclosure, it is considered that these features may be modified as a part of the generation process for an HRTF dataset (that is, a collection of HRTFs to be used for audio reproduction). This modification may comprise the modifying of each of the sets of features, or either of them—that is to say that the generation process may comprise modifying one or both of these sets of features in accordance with the present disclosure.

FIG. 1 schematically illustrates a scenario in which a listener 100 receives audio from a sound source 110 that is positioned in front of and to the right of the listener 100. In such a scenario there will be significant pinnae notches in the spectral response of the right ear while, head/body shadowing will limit the spectral response for the left ear. These differences between the spectral responses of each ear are reflected in the respective HRTFs for each ear, and as such any audio generated at that position using the HRTFs will produce audio with a correct localisation for that listener.

Figure 2:
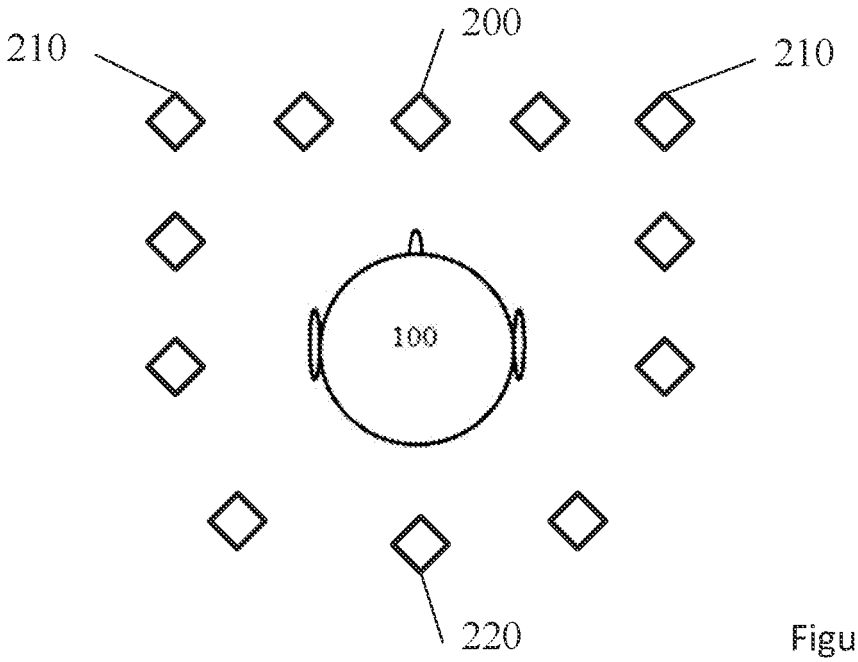
FIG. 2 schematically illustrates a selection of virtual sound source locations.

FIG. 2 schematically illustrates a selection of virtual sound source locations in an environment, with the selection of sound sources having a respective corresponding pair of HRTFs (that is, one for each of the right and the left ear of the listener). The example of FIG. 2 shows a two-dimensional array of sound source locations to aid the clarity of the following discussion; of course, it should be appreciated that a three-dimensional array of locations (and corresponding HRTFs) may be more practical in many embodiments. Similarly, the locations shown are each of a similar distance from the position of the listener 100; however, a range of different distances may be considered, including both near- and far-field locations.

In the example of FIG. 2, it may be expected that the location 200 has a pair of corresponding HRTFs that are very similar (and possibly identical) for each of the listener's ears given that the location is equidistant from each of the listener's ears and the incident angle at which audio reaches the listener's ears will be the same.

The locations 210 are on either side of the listener's head, and as such it is expected that the pair of HRTFs corresponding to each location will be much more distinct from one another than those in the pair at the location 200. For instance, the HRTF on the corresponding side (for instance, the HRTF for the right ear when considering the location to the right of the listener) will have a much more significant response than the HRTF for the opposite (contralateral) side.

The location 220 directly behind the listener's head may have a symmetric (or nearly symmetric) response defined for each ear in the corresponding HRTFs due to the location—however being behind the user the response would be expected to be lower due to the shape of the listener's ears and the like not being conducive to hearing sounds in the rear direction.

Figure 3:
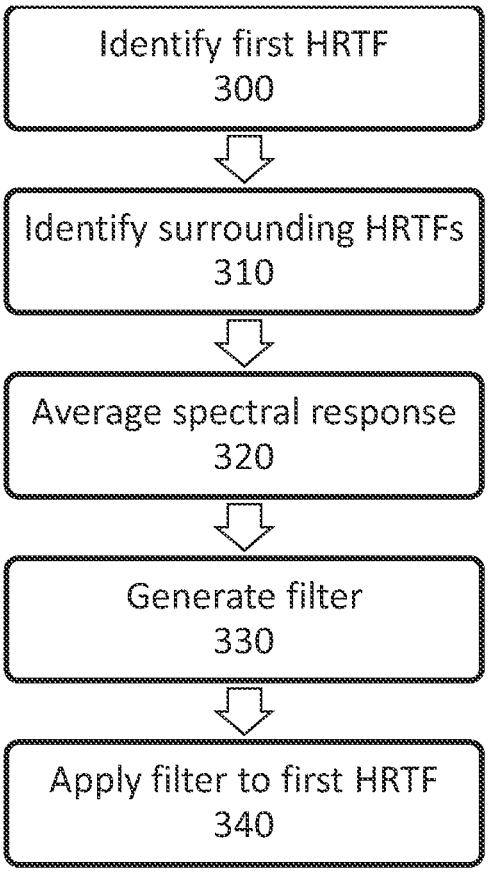
FIG. 3 schematically illustrates a method for modifying an ipsilateral response of an HRTF.

FIG. 3 schematically illustrates a method for modifying the spectral response of an HRTF (belonging to an obtained HRTF dataset) so as to reduce timbral changes caused by the HRTFs. This may be performed for any number of HRTFs within an HRTF dataset, and in some embodiments may be performed for each of the HRTFs within a dataset.

At a step 300, a first HRTF (that is, an HRTF belonging to the obtained HRTF dataset) and the location associated with the first HRTF is identified. The first HRTF may be any HRTF present in the dataset; it is expected that such processing may be utilised for each (or at least a substantial number) of the HRTFs within the dataset, and as such it is not considered that any particular selection criteria is required for the first HRTF in many embodiments. This location may be expressed in any suitable manner, although an angular identification of the location (optionally with an associated distance) may be considered to be particularly appropriate in some embodiments.

At a step 310, one or more other HRTFs surrounding the first HRTF (that is, the HRTF that is identified in step 300) are also identified. Surrounding here refers to HRTFs that are within a predetermined distance of the first HRTF; this may be a calculated proximity (such as a comparison of the locations to determine a straight-line distance), for example. Alternatively, or in addition, the relative locations as determined in dependence upon an angular separation (with the apex being defined using an origin at the listener's position) such as being located within a sector, centred upon the first HRTF, having a predetermined angular size. The proximity may therefore be defined as a perceived proximity—that is to say that the proximity may be determined based upon the similarity of direction as perceived by a listener, rather than an absolute spatial proximity.

Figure 4:
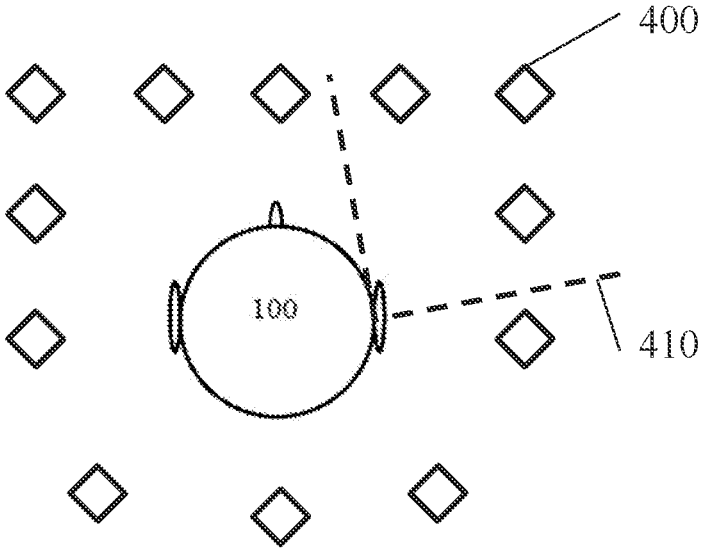
FIG. 4 schematically illustrates a two-dimensional representation of HRTF locations.

A two-dimensional example of this is shown in FIG. 4; the HRTF indicated by the reference 400 is the HRTF for which a location is identified in step 300, while the dashed lines 410 represent the sector having an approximately ninety degree angle. Such a sector, when centred upon the HRTF 400, therefore defines a region spanning forty-five degrees either side of the HRTF 400. The angle that is used to define the sector size may be selected freely, rather than being limited to the example shown here; appropriate angles may include five, ten, twenty, or 30 degrees for example, or may be larger such as fifty, seventy-five, or one-hundred degrees or more. The angle defining the sector may be defined in dependence upon any of a number of factors, including the HRTF density within the HRTF dataset (for example, a lower density may encourage the use of a larger angle to increase sample size), the angle of the selected HRTF relative to the user, and/or user preferences relating to how aggressive the processing should be.

Figure 5:
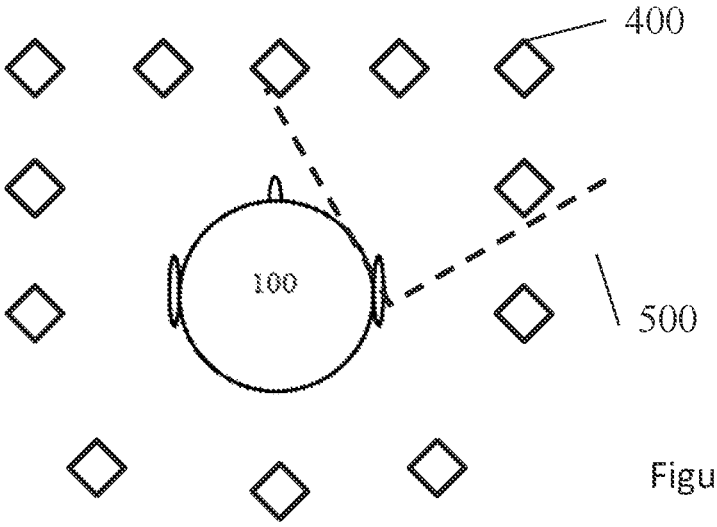
FIG. 5 schematically illustrates a further two-dimensional representation of HRTF locations.

In some embodiments, it may be considered advantageous to define the sector so as to not comprise an equal portion in every direction about the identified HRTF. For instance, it may be considered appropriate that HRTFs in a particular direction (such as those in a more central area or those above rather than below the listener) may be more relevant in some embodiments. A two-dimensional example (comparable to that of FIG. 4) is shown in FIG. 5; the sector 500 appears offset relative to that of FIG. 4 so as to capture a greater number of HRTFs in a more central region relative to those to the right-hand side of the listener. The sector 500 may be defined using a pair of angles (such as an angle for each side of the HRTF), for example, or by a single angle and an angular offset to achieve the desired effect. Of course, such an offset is entirely exemplary—different embodiments may assign a different significance to each direction, for instance based upon typical sound source directions for an application, and as such some may favour an offset that gathers more side/rear HRTFs than front/central.

A sector such as this may also have an associated distance threshold, such that HRTFs more than a threshold distance from the listener or the first HRTF are not considered. This may be beneficial in that it can enable a separation of near- and far-field responses if appropriate; a similar approach is also considered in which a threshold is (additionally or alternatively) defined between the listener and the HRTF 400 to further constrain the additional HRTF identification process.

At a step 320, the spectral response of each of the identified HRTFs (that is, the HRTFs within the defined sector) is averaged. This step may include any suitable processing that generates a representative response (the average, or any other suitable measure) of the considered plurality of responses. For instance, the spectral response at each frequency for each of the HRTFs may be summed and divided by the number of HRTFs; alternatively, or additionally (such as for only a subset of the frequencies considered in the HRTF), a weighted average may be generated based upon HRTF proximity and/or other factors (such as a perceived quality of an HRTF, for instance based upon recording conditions). Similarly, a median value of the response for each (or a number of) frequencies may be considered to be a suitable representative value. The averaging may take any suitable form, with the processing here being intended to derive a representation of the typical response for HRTFs within a threshold proximity of the identified location. In the case that an HRTF comprises both an ipsilateral and a contralateral response, it is considered that the same response should be selected for averaging from each HRTF.

At a step 330, a filter is generated in dependence upon the averaged spectral response generated in step 320. In particular, this filter may be generated so as to remove the averaged spectral response (or at least one aspect of the averaged response) from the first HRTF. One example of such a filter is a simple subtraction of the averaged response so as to isolate the response specific to each HRTF. Similarly, a subtraction filter may subtract a scaled (such as sixty or eighty percent) proportion of the average that is calculated in step 320.

At a step 340, the generated filter is applied to the first HRTF, generating a modified HRTF. This modified HRTF may replace the first HRTF in the obtained HRTF dataset, or may be added to a new HRTF dataset so as to preserve the original HRTF dataset during the modification process.

As noted above, the two-dimensional example that is discussed is considered to be exemplary for the sake of clarity of the discussion. In real-world implementations it is expected that three-dimensional HRTFs are used and therefore three-dimensional methods are appropriate. The methods described in this document may be readily adapted for such purposes; for instance, rather than considering a two-dimensional sector a spherical (three-dimensional) sector with a predetermined angular size and an apex at the position of the listener may be used. The size of the spherical sector may be determined freely in each direction as discussed above with reference to the two-dimensional sector.

In either case, it is also considered that non-regular shapes may be used to define a region of proximity for the identified HRTF. For instance, a sector may be defined with curved or otherwise non-linear sides as appropriate. While this may increase the computational complexity, a more specifically prescribed region of proximity may enable the generation of an improved HRTF dataset relative to the use of a method with regular sectors.

In summary, the method of FIG. 3 may be considered to be a zonal transfer function equalisation to be used for one or responses of HRTFs in an HRTF dataset. This method serves to reduce or entirely remove the average response of the HRTFs from each HRTF on an HRTF-specific basis (that is to say that it is expected that each HRTF is modified in a different manner due to the identification of different surrounding HRTFs). This has the effect of removing (or at least reducing) the contribution of general timbral changes to each of the HRTFs. As noted above, the modified HRTFs may be used directly for audio reproduction or may be modified further to alter one or more characteristics; in some embodiments, this may include the implementation of a desired timbre for example.

While such a method may be considered to be more appropriate for modifying ipsilateral responses, this is not an exclusive feature. That is to say that the method of claim 3 may be applied equally to modify both ipsilateral responses and/or contralateral responses as desired.

Figure 6:
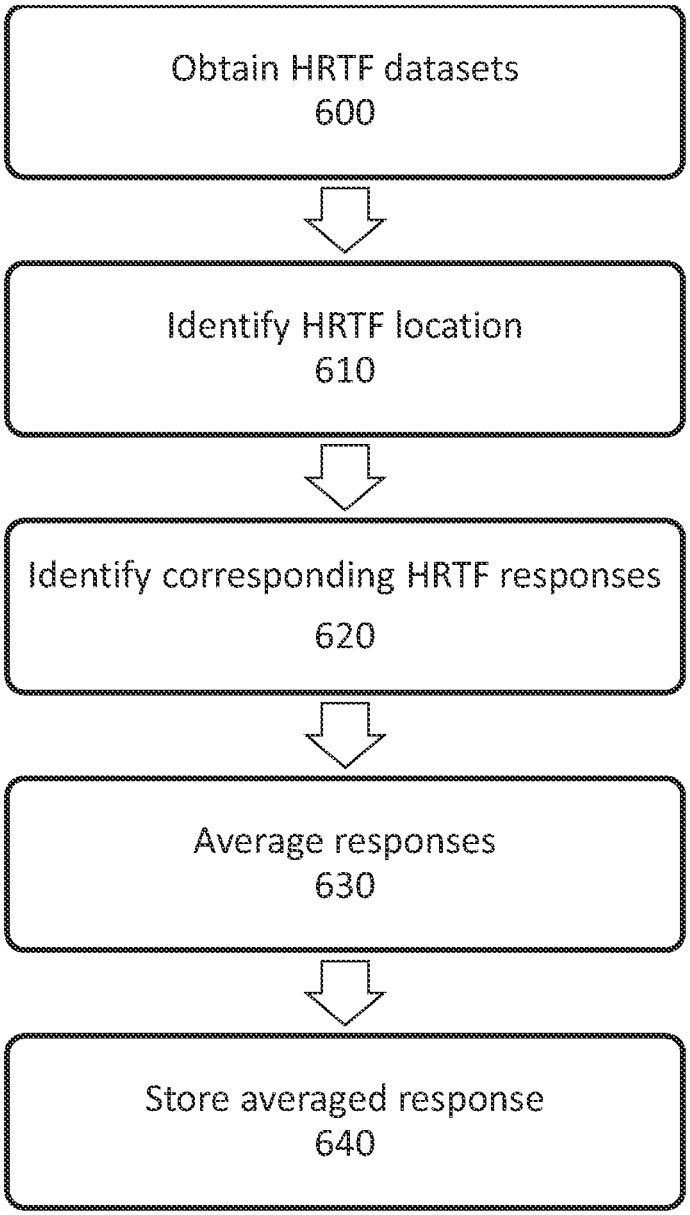
FIG. 6 schematically illustrates a method for modifying a contralateral response of an HRTF.

Alternatively, or in addition, different processing may be performed so as to improve the contralateral response. An example of such processing is shown in FIG. 6, which schematically illustrates a method for generating one or more HRTFs for an HRTF dataset. This method may be used in conjunction with the method of FIG. 3 as appropriate; as noted above the method of FIG. 6 considers the contralateral response aspect of HRTFs, while the method of FIG. 3 may be more effective for use with HRTFs representing an ipsilateral (same side) response.

At a step 600, a first HRTF dataset is obtained along with one or more additional HRTF datasets. These datasets may be obtained from any suitable source; they may be locally stored, for example, or retrieved from an online repository. These HRTF datasets may be generated for any listener and any environment as appropriate; it is considered that any selected HRTF dataset may be appropriate. Of course, HRTF datasets with a greater number of HRTFs may be considered advantageous as may datasets with a known high quality of data (such as those generated by a source with a high standard of recording equipment).

At a step 610, the location of an HRTF within the first HRTF dataset is identified. As the method is intended to be implemented for each of a number of different locations, the selection of an initial HRTF is considered to be a trivial matter.

At a step 620, the contralateral response of HRTFs corresponding to that location is identified from one or more of the additional HRTF datasets obtained in step 600. That is to say that one or more HRTF datasets are analysed to identify HRTFs at a corresponding location, and that the identified HRTFs are those which relate to the response of the ear on the opposite side of the listener's head. The corresponding location may be determined based upon only the angle of the HRTF relative to the listener, or may also consider the distance from the listener. A corresponding location may require an exact location match in some embodiments (for instance, if multiple HRTF datasets each comprise HRTFs recorded at the same locations), or a corresponding location may also include locations within a threshold angular or absolute threshold distance from the location. For instance, the location may be specified as a range of acceptable angles (effectively acting as a tolerance on the correspondence of the locations) rather than a single angle for each axis.

At a step 630, the identified contralateral responses are averaged. As discussed above with reference to step 320 of FIG. 3, this averaging may comprise summing the spectral response at each frequency and dividing the sum by the number of responses that are summed. Alternatively, or in addition, any other method of determining a representative response may be considered appropriate.

At a step 640, the averaged HRTF response at the identified location is saved as a part of a new HRTF dataset, and/or used to replace the corresponding HRTF in one or more of the HRTF datasets used to generate the averaged response. This has the effect of setting the HRTF response as the average of the considered HRTF responses from a number of different HRTF datasets.

This method may be repeated for a number of, or in some cases all of, the HRTFs in a dataset; by considering a number of different HRTF datasets it may be possible to generate a higher resolution dataset than any of the individual datasets that are considered as the HRTF datasets can effectively be combined.

The method of FIG. 6 considers that the contralateral response may be the same, or at least suitably similar, across a number of different HRTF datasets. This is because there is a lack of clear pinnae notches in the contralateral response, which means that the differences between contralateral responses for different users are reduced relative to corresponding ipsilateral responses. This is not to say that there are no notches present, but that they may be less distinct than in ipsilateral responses. In view of this, it is considered that setting the contralateral response to be equal for a plurality of HRTF datasets may only have a small impact on sound quality, but in increasing the consistency there can be an improvement between HRTF datasets which can improve a listener experience.

Such a method, when performed for a plurality of different HRTF positions relative to a listener, can generate contralateral responses for the entire environment. However, it may be preferable in some embodiments to instead only generate contralateral responses in this manner for a portion of the environment. For instance, those contralateral responses which are in a central region in front of the user may exhibit more distinct peaks due to their location; that is, due to a reduction in head shadowing and the like these contralateral responses may have a more distinctive spectral response than typical contralateral responses. It is therefore considered that the skilled person may select an appropriate group of HRTFs, in dependence upon their location, for performing such a method so as to achieve a desired level of quality or efficiency or the like.

In some examples, the decision about whether to perform the method of FIG. 6 may be taken in dependence upon an analysis of the response in an HRTF. For instance, an analysis may determine the distinctiveness of peaks present in the response based upon one or more statistical properties of the response, such as variation in magnitude or gradient or the like.

Figure 7:
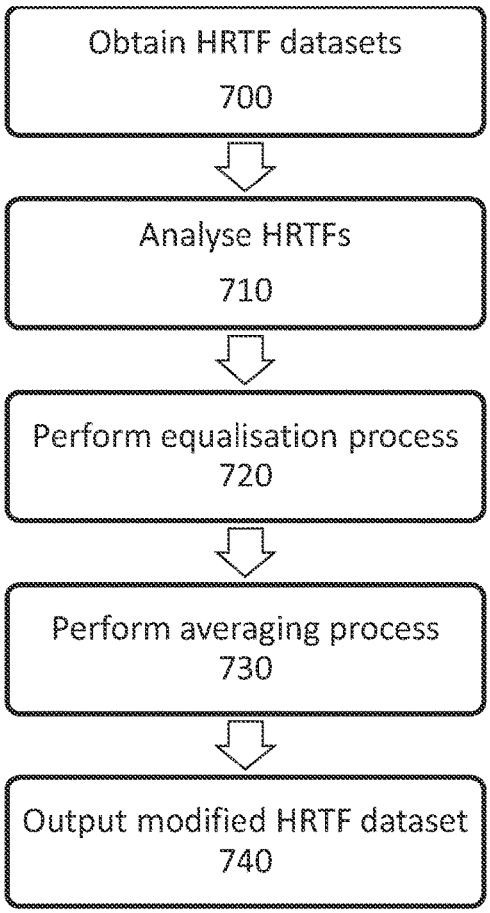
FIG. 7 schematically illustrates a combined HRTF dataset modification method.

In a number of embodiments, it is considered that each of the methods of FIGS. 3 and 6 as discussed above may be implemented to generate a single HRTF dataset. FIG. 7 schematically illustrates such a method. It should be appreciated that the order of steps shown below may be modified; it is not required that steps 710 and 720 are performed in the described order, and they may be performed in parallel if desired.

A step 700 comprises obtaining a first HRTF dataset and one or more additional HRTF datasets. As noted above, these datasets may be obtained from any suitable source and may include one or more locally recorded HRTF datasets where appropriate.

A step 710 comprises performing an HRTF analysis process so as to determine one or more characteristics of at least a subset of the HRTFs within the first HRTF dataset. One example of such a process is that of identifying a location associated with each (or at least a number) of the HRTF responses within at least the first HRTF dataset. Such a process is performed so as to determine which HRTF responses are suitable as an input to the process of step 720 (that is, which are considered ipsilateral), and which are suitable as an input to the step 730 (that is, which are considered contralateral).

A step 720 comprises implementing the method of FIG. 3; that is to say that a zonal transfer function equalisation process is performed so as to generate an HRTF dataset that is modified so as to reduce (or remove) the timbre associated with at least a number of HRTFs within the first HRTF dataset. This step is performed for one or more ipsilateral HRTF responses within the first HRTF dataset.

A step 730 comprises implementing the method of FIG. 6; that is to say that a method is performed that generates a representative contralateral HRTF for a particular HRTF location in dependence upon the HRTFs at the same (or substantially similar) location as present in a plurality of HRTF datasets. This step is performed for one or more contralateral HRTF responses within the first HRTF dataset. Such a method is utilised for contralateral HRTF responses, and as such this step can be performed before or after step 710 as the two steps effectively use different parts of the first HRTF dataset in many embodiments.

A step 730 comprises outputting a modified HRTF dataset comprising the HRTFs as generated using each of the above steps. This dataset may be stored for later use, and may be stored locally or distributed as appropriate.

In many cases, the step 710 may comprise a simple binary determination that identifies which response within an HRTF corresponds to which side. However, in some embodiments there is not a binary ipsi-/contra-lateral determination based upon an identified location; instead, HRTF responses may be characterised by their responses. For instance, the analysis process may include identifying the pinnae notches within a response. Based upon this identification, a HRTF response may be identified as being contralateral or ipsilateral depending on the existence, magnitude, clarity (that is, magnitude relative to the rest of the response), number, and/or sharpness of the notches. Those responses without sufficiently distinct or sizeable notches may be considered contralateral for the purpose of this method (Even if not strictly contralateral in location), while other responses are considered ipsilateral.

Such a categorisation may lead to the process of step 720 being performed for a number of contralateral (based on location) HRTF responses—for example, those HRTF responses associated with a location that is within a region directly in front of a user may be considered ipsilateral for both ears if there are significant notches.

Figure 8:
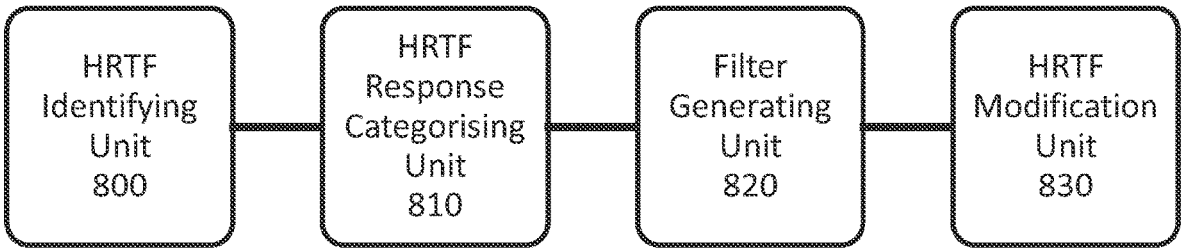
FIG. 8 schematically illustrates a first HRTF dataset modification system.

FIG. 8 schematically illustrates a head-related transfer function, HRTF, dataset modification system that may be configured to perform one or more methods in line with those described above with reference to FIG. 3. The system comprises an HRTF identifying unit 800, an optional HRTF response categorising unit 810, a filter generating unit 820, and an HRTF modification unit 830. One or more additional components may also be provided, such as hardware suited for storing the HRTF datasets (such as hard drives) and/or obtaining/recording HRTF datasets (such as networking components or disk drives). The units described as forming this system may be implemented in any suitable manner; for instance, a single processor (such as a CPU or GPU) may be configured to perform each of the processing functions, or a number of processors distributed across a number of devices (including local and cloud devices, for instance) may be configured to perform the below functions.

The HRTF identifying unit 800 is operable to identify a first HRTF from an HRTF dataset. The first HRTF may be selected freely, as it is intended that this method should be performed for each of a number of different HRTFs within the HRTF dataset. In view of this, the order in which the HRTFs are modified does not impact the final output. The identification may include obtaining any suitable information about the HRTF; for instance, the location and ipsilateral/contralateral responses may be obtained.

The optional HRTF response categorising unit 810 that is operable to determine whether modification of a spectral response in the identified HRTF is to be performed, wherein if it is determined that the modification is not to be performed a new HRTF from the HRTF dataset is selected. The HRTF response categorising unit 810 may be operable to determine whether an HRTF is to be modified in dependence upon the location of the HRTF and/or one or more characteristics of the HRTF response.

That is to say that in some embodiments, this may comprise determining whether the HRTF response is suitable for modification using this process; in particular, this may be an identification of whether the response is an ipsilateral response based upon its location. Alternatively, or in addition, a determination may be made based upon the presence of notches (and/or their significance) within the response as discussed above. This can lead to the application of this method to a number of contralateral responses with significant notches in addition to ipsilateral responses that are envisaged as the primary use case for such processing.

The filter generating unit 820 is operable to generate a filter in dependence upon the first HRTF, wherein the generating comprises the steps of identifying a spectral response of the first HRTF, identifying one or more second HRTFs within the HRTF dataset, each within a predetermined distance of the first HRTF, and a corresponding spectral response associated with each of the second HRTFs, generating an average of each of the identified spectral responses of the first and second HRTFs, and generating a filter using the inverse of this average. Here, average may be taken to mean any representative response generated using the identified HRTFs; as discussed above, median response values or the like may also be considered.

In some embodiments, the filter is generated only for, and in dependence upon, ipsilateral HRTF responses. This is discussed above with reference to the HRTF response categorising unit 810. The corresponding spectral responses of the second HRTFs are considered to be corresponding in that they represent the same response as the identified response of the first HRTF. That is to say that if the identified response of the first HRTF is an ipsilateral response (for example), then the corresponding spectral responses of the second HRTFs should also be ipsilateral.

In a number of embodiments, the predetermined distance (used to identify the one or more second HRTFs) is identified in dependence upon the location of the first HRTF. This is discussed above with reference to FIG. 5; that is to say that the distance may vary in dependence upon the location of the HRTF being modified. In some embodiments, the predetermined distance is defined by a threshold angular separation as measured from the listener position within the HRTF dataset. Alternatively, or in addition, the predetermined distance may be defined by a volume centred upon the first HRTF.

The HRTF modification unit 830 is operable to modify the first HRTF by applying the generated filter to the identified spectral response to generate an output HRTF. The output HRTF may be used to generate a new HRTF dataset, or may be temporarily stored before replacing the original HRTF in the existing HRTF dataset (with the replacement being delayed so as to reduce the impact on the modification of other responses due to the new HRTF differing from the original).

The arrangement of FIG. 8 is an example of a processor (for example, a GPU and/or CPU located in a games console or any other computing device) that is operable to perform an HRTF dataset modification, and in particular is operable to:

- identify a first HRTF from an HRTF dataset;
- generate a filter in dependence upon the first HRTF, wherein the generating comprises the steps of:
  - identifying a spectral response of the first HRTF,
  - identifying one or more second HRTFs within the HRTF dataset, each within a predetermined distance of the first HRTF, and a spectral response associated with each of the second HRTFs,
  - generating an average of each of the identified spectral responses of the first and second HRTFs, and
  - generating a filter using the inverse of this average; and
- modify the first HRTF by applying the generated filter to the identified spectral response to generate an output HRTF.

Figure 9:
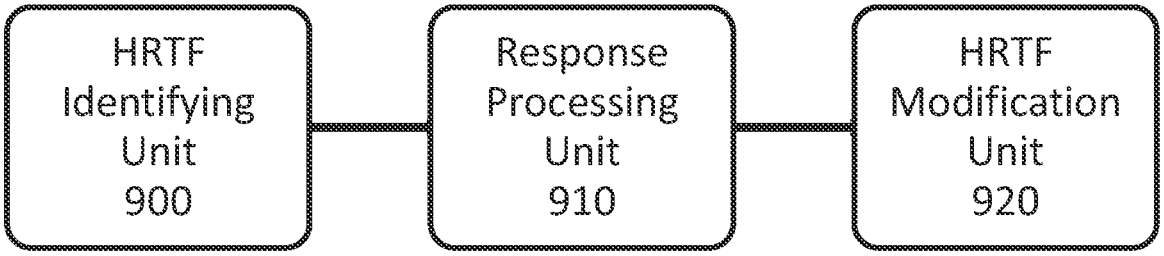
FIG. 9 schematically illustrates a second HRTF dataset modification system.

FIG. 9 schematically illustrates a head-related transfer function, HRTF, dataset modification system that may be configured to perform one or more methods in line with those described above with reference to FIG. 6. The system comprises an HRTF identifying unit 900, a response processing unit 910, and an HRTF modification unit 920. One or more additional components may also be provided, such as hardware suited for storing the HRTF datasets (such as hard drives) and/or obtaining/recording HRTF datasets (such as networking components or disk drives). The units described as forming this system may be implemented in any suitable manner; for instance, a single processor (such as a CPU or GPU) may be configured to perform each of the processing functions, or a number of processors distributed across a number of devices (including local and cloud devices, for instance) may be configured to perform the below functions.

The HRTF identifying unit 900 is operable to identify a first HRTF from an HRTF dataset and one or more additional HRTFs at a corresponding location in each of one or more additional HRTF datasets. The additional HRTF datasets may be for the same or different listeners (or models of listeners, as it is appreciated that a real listener is not always used for HRTF generation), and the recording environment may vary between them as appropriate. In some embodiments, the additional HRTF datasets may have processing applied in advance so as to reduce the contribution of these factors to the HRTF responses.

The response processing unit 910 is operable to identify a contralateral response of each identified HRTF, and to generate a representative response for the identified contralateral responses. As noted above, this representative response may be an average of the identified contralateral responses. Alternatively, or in addition, any other statistical analysis may be performed so as to identify a response that is representative of the obtained samples—examples include considering median values and weighted averages.

In some embodiments, one or more additional responses may also (or instead) be identified and have a corresponding processing applied. For instance, in some embodiments a number of ipsilateral responses may also be selected if the responses do not exhibit strong pinnae notches—an example of this is considering HRTFs located to the rear of the user's head. In other words, it is considered that the response processing unit 910 may instead be operable to identify at least a contralateral response of each identified HRTF (and apply processing separately for each identified response of each identified HRTF), or may additionally or instead be operable to identify an ipsilateral response for one or more of the identified HRTFs where appropriate.

As noted above, an appropriate ipsilateral response for selection may be one for which pinnae notches are considered to be of low significance (for instance, due to having a low magnitude), and/or one which satisfies a particular angular condition. An example of such an angular condition is that of being within an azimuthal angular range of the boundary between ipsilateral and contralateral responses; for instance, with one hundred and eighty degrees indicating the direct rear of the listener's head it may be considered that ipsilateral responses may be selected (in addition to or instead of contralateral responses) for HRTFs having an azimuth angle between one hundred and seventy five and one hundred and eighty five degrees. These numbers are entirely exemplary, and any other values may be selected as appropriate. These angles need not be indicative of a symmetric deviation from the base angle; for instance, in the case that a user has poor hearing in one ear, or for content in which one side is usually neglected for audio reproduction (such as audio content which has a source direction that is predominantly to the right of a user). In such cases, an appropriate range may be defined as on hundred and seventy five to one hundred and ninety five degrees (thereby performing more processing on the left side of the listener); of course, such numbers are entirely illustrative and any appropriate definition of the angular range may be considered.

In some embodiments, the modification discussed may be performed for a number of HRTF responses and the angular range (or other conditions) may be determined at a later time. In such a case, processing may be performed to determine which version of the HRTF response should be used at a later time. This determination may be based upon any suitable feedback, including an analysis of the deviation between the original and modified HRTF responses or a testing process in which one or more listeners are subjected to audio content generated using each HRTF response and indicate which is the preferred reproduction (and therefore which HRTF response to use in the final HRTF dataset).

The HRTF modification unit 920 is operable to replace the contralateral (or other) response of the first HRTF with the generated representative response. In some embodiments, the HRTF modification unit 920 may be operable to also replace the contralateral response of the one or more additional HRTFs with the generated representative response. Such a process results in a uniform contralateral response at a given location amongst a plurality of HRTF datasets.

The arrangement of FIG. 9 is an example of a processor (for example, a GPU and/or CPU located in a games console or any other computing device) that is operable to perform an HRTF dataset modification, and in particular is operable to:

- identify a first HRTF from an HRTF dataset and one or more additional HRTFs at a corresponding location in each of one or more additional HRTF datasets;
- identify a contralateral response of each identified HRTF, and to generate a representative response for the identified contralateral responses; and
- replace the contralateral response of the first HRTF with the generated representative response.

Figure 10:
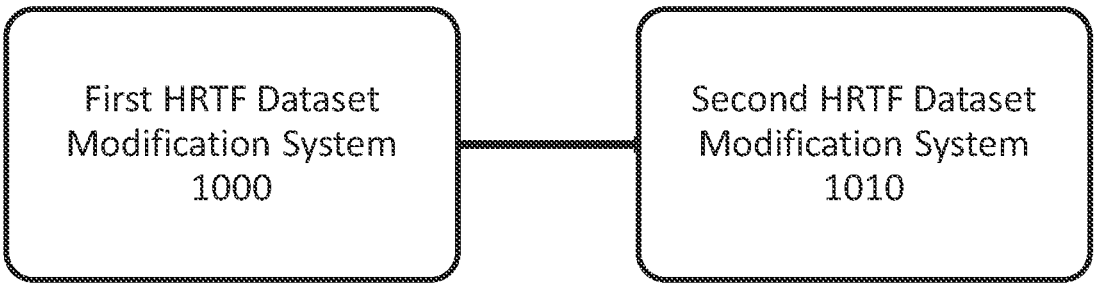
FIG. 10 schematically illustrates a combined HRTF dataset modification system.

FIG. 10 schematically illustrates head-related transfer function, HRTF, dataset modification system comprising the system of FIG. 8 (the first HRTF dataset modification system 1000) and the system of FIG. 9 (the second HRTF dataset modification system 1010), wherein the system of FIG. 8 (1000) is used to modify at least ipsilateral responses one or more HRTFs in a first HRTF dataset and the system of FIG. 9 (1010) is used to modify contralateral responses of one or more HRTFs in the same HRTF dataset.

Figure 11:
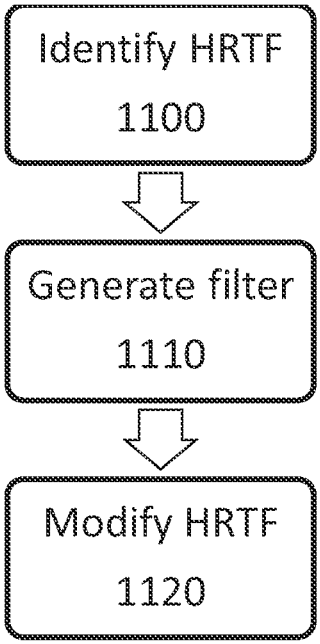
FIG. 11 schematically illustrates a first HRTF dataset modification method.

FIG. 11 schematically illustrates head-related transfer function, HRTF, dataset modification method in line with the method discussed with reference to FIG. 3.

A first step 1100 comprises identifying a first HRTF from an HRTF dataset.

An optional intermediate step may be performed between steps 1100 and 1110, this step comprising determining whether modification of a response in the first HRTF is to be performed, wherein if it is determined that the modification is not to be performed a new HRTF from the HRTF dataset is selected.

A step 1110 comprises generating a filter in dependence upon the first HRTF, wherein the generating comprises the steps of:

- identifying a spectral response of the first HRTF,
- identifying one or more second HRTFs within the HRTF dataset, each within a predetermined distance of the first HRTF, and a corresponding spectral response associated with each of the second HRTFs,
- generating an average of each of the identified spectral responses of the first and second HRTFs, and
- generating a filter using the inverse of this average.

A step 1120 comprises modifying the first HRTF by applying the generated filter to the identified spectral response to generate an output HRTF.

Figure 12:
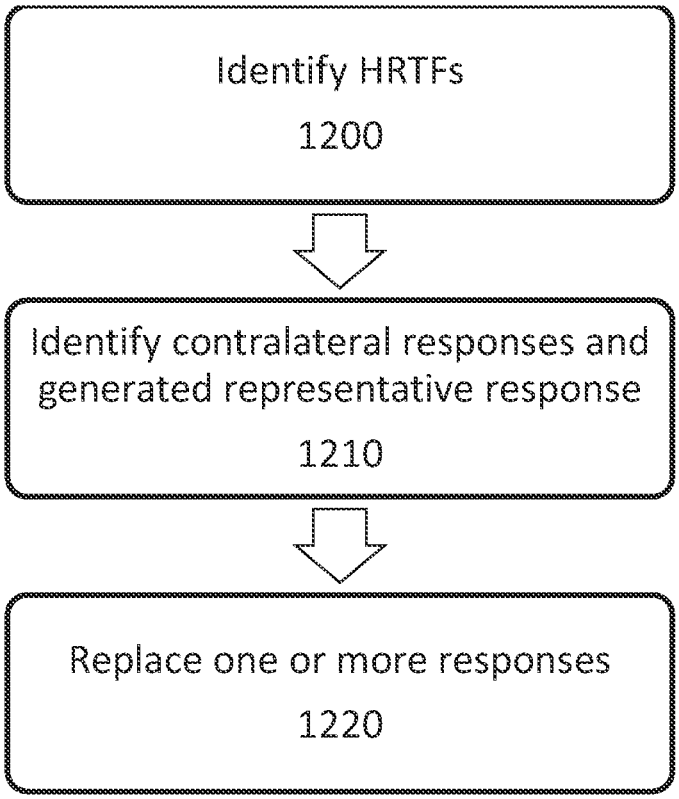
FIG. 12 schematically illustrates a second HRTF dataset modification method.

FIG. 12 schematically illustrates head-related transfer function, HRTF, dataset modification method in line with the method discussed with reference to FIG. 6.

A step 1200 comprises identifying a first HRTF from an HRTF dataset and one or more additional HRTFs at a corresponding location in each of one or more additional HRTF datasets.

A step 1210 comprises identifying a contralateral response of each identified HRTF, and generating a representative response for the identified contralateral responses.

A step 1220 comprises replacing the contralateral response of the first HRTF with the generated representative response. As noted above, in some embodiments the response may also be replaced for each or a number of the additional HRTFs.

As discussed above with reference to FIG. 10, embodiments are considered in which both HRTF modification processes are applied to the same HRTF dataset in succession or in parallel. This may be regarded as an HRTF dataset modification method comprising the steps of the method of claim 11 and the steps of the method of claim 12, wherein the method of claim 11 is used to modify ipsilateral responses one or more HRTFs of a first HRTF dataset and the method of claim 12 is used to modify contralateral responses of one or more HRTFs in the same HRTF dataset.

The techniques described above may be implemented in hardware, software or combinations of the two. In the case that a software-controlled data processing apparatus is employed to implement one or more features of the embodiments, it will be appreciated that such software, and a storage or transmission medium such as a non-transitory machine-readable storage medium by which such software is provided, are also considered as embodiments of the disclosure.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

Embodiments of the present disclosure may be configured in accordance with one or more of the following numbered clauses:

1. A head-related transfer function, HRTF, dataset modification system, the system comprising:
   - an HRTF identifying unit operable to identify a first HRTF from an HRTF dataset;
   - a filter generating unit operable to generate a filter in dependence upon the first HRTF, wherein the generating comprises the steps of:
     - identifying a spectral response of the first HRTF,
     - identifying a one or more second HRTFs within the HRTF dataset, each within a predetermined distance of the first HRTF, and a corresponding spectral response associated with each of the second HRTFs,
     - generating an average of each of the identified spectral responses of the first and second HRTFs, and
     - generating a filter using the inverse of this average; and an HRTF modification unit operable to modify the first HRTF by applying the generated filter to the identified spectral response to generate an output HRTF.

2. A system according to clause 1, wherein the filter is generated only for, and in dependence upon, ipsilateral HRTF responses.

3. A system according to any preceding clause, comprising an HRTF response categorising unit that is operable to determine whether modification of a response in the first HRTF is to be performed, wherein if it is determined that the modification is not to be performed a new HRTF from the HRTF dataset is selected.

4. A system according to clause 3, wherein the HRTF response categorising unit is operable to determine whether an HRTF is to be modified in dependence upon the location of the HRTF and/or one or more characteristics of the HRTF response.

5. A system according to any preceding clause, wherein the predetermined distance is identified in dependence upon the location of the first HRTF.

6. A system according to any preceding clause, wherein the predetermined distance is defined by a threshold angular separation as measured from the listener position within the HRTF dataset.

7. A system according to any preceding clause, wherein the predetermined distance is defined by a volume centred upon the first HRTF.

8. A head-related transfer function, HRTF, dataset modification system, the system comprising:

an HRTF identifying unit operable to identify a first HRTF from an HRTF dataset and one or more additional HRTFs at a corresponding location in each of one or more additional HRTF datasets;

a response processing unit operable to identify a contralateral response of each identified HRTF, and to generate a representative response for the identified contralateral responses; and an HRTF modification unit operable to replace the contralateral response of the first HRTF with the generated representative response.

9. A system according to clause 8, wherein the HRTF modification unit is operable to also replace the contralateral response of the one or more additional HRTFs with the generated representative response.

10. A head-related transfer function, HRTF, dataset modification system comprising the system of clause 1 and the system of clause 8, wherein the system of clause 1 is used to modify at least ipsilateral responses one or more HRTFs in a first HRTF dataset and the system of clause 8 is used to modify contralateral responses of one or more HRTFs in the same HRTF dataset.

11. A head-related transfer function, HRTF, dataset modification method, the method comprising:

identifying a first HRTF from an HRTF dataset;

generating a filter in dependence upon the first HRTF, wherein the generating comprises the steps of:

identifying a spectral response of the first HRTF, identifying one or more second HRTFs within the HRTF dataset, each within a predetermined distance of the first HRTF, and a corresponding spectral response associated with each of the second HRTFs, generating an average of each of the identified spectral responses of the first and second HRTFs, and generating a filter using the inverse of this average; and modifying the first HRTF by applying the generated filter to the identified spectral response to generate an output HRTF.

12. A head-related transfer function, HRTF, dataset modification method, the method comprising:

identifying a first HRTF from an HRTF dataset and one or more additional HRTFs at a corresponding location in each of one or more additional HRTF datasets;

identifying a contralateral response of each identified HRTF, and generating a representative response for the identified contralateral responses; and replacing the contralateral response of the first HRTF with the generated representative response.

13. A head-related transfer function, HRTF, dataset modification method comprising the steps of the method of clause 11 and the steps of the method of clause 12, wherein the method of clause 11 is used to modify ipsilateral responses one or more HRTFs of a first HRTF dataset and the method of clause 12 is used to modify contralateral responses of one or more HRTFs in the same HRTF dataset.

14. Computer software which, when executed by a computer, causes the computer to carry out the method of any of clauses 11-13.

15. A non-transitory machine-readable storage medium which stores computer software according to clause 14.

The invention claimed is:

1. A head-related transfer function, HRTF, dataset modification system, the system comprising:

an HRTF identifying unit operable to identify a first HRTF from an HRTF dataset and to identify a first virtual sound source location associated with the first HRTF;

a filter generating unit operable to generate a filter in dependence upon the first HRTF, wherein the generating comprises the steps of:

identifying a spectral response of the first HRTF, identifying one or more second HRTFs within the HRTF dataset, each such one or more second HRTFs being associated with a respective second virtual sound source location within a predetermined distance of the first virtual sound source location associated with the first HRTF, and a corresponding spectral response associated with each of the second HRTFs, generating an average of each of the identified spectral responses of the first and second HRTFs, and generating a filter using the inverse of this average; and an HRTF modification unit operable to modify the first HRTF by applying the generated filter to the identified spectral response to generate an output HRTF.

2. The system of claim 1, wherein the filter is generated only for, and in dependence upon, ipsilateral HRTF responses.

3. The system of claim 1, comprising an HRTF response categorising unit that is operable to determine whether modification of a response in the first HRTF is to be performed, wherein if it is determined that the modification is not to be performed a new HRTF from the HRTF dataset is selected.

4. The system of claim 3, wherein the HRTF response categorising unit is operable to determine whether an HRTF is to be modified in dependence upon the location of the HRTF and/or one or more characteristics of the HRTF response.

5. The system of claim 1, wherein the predetermined distance is identified in dependence upon the location of the first virtual sound source location of the first HRTF.

6. The system of claim 1, wherein the predetermined distance is defined by a threshold angular separation as measured from the listener position within the HRTF dataset.

7. The system of claim 1, wherein the predetermined distance is defined by a volume centred upon the first HRTF.

8. The system of claim 1, further comprising:

a response processing unit operable to identify a contralateral response of each identified HRTF, and to generate a representative response for the identified contralateral responses; and an HRTF modification unit operable to replace the contralateral response of the first HRTF with the generated representative response.

9. The system of claim 8, wherein the HRTF modification unit is operable to also replace the contralateral response of the one or more additional HRTFs with the generated representative response.

10. The system of claim 1, wherein:

a first HRTF dataset modification system used to modify at least ipsilateral responses of one or more HRTFs in a first HRTF dataset, includes the HRTF identifying unit, the filter generating unit, and the HRTF modification unit; and the system further comprises:

a second HRTF dataset modification system used to modify contralateral responses of one or more HRTFs in the same HRTF dataset, the system comprising:

an HRTF identifying unit operable to identify a first HRTF from an HRTF dataset and one or more additional HRTFs at a corresponding location in each of one or more additional HRTF datasets;

a response processing unit operable to identify a contralateral response of each identified HRTF, and to generate a representative response for the identified contralateral responses; and an HRTF modification unit operable to replace the contralateral response of the first HRTF with the generated representative response.

11. A head-related transfer function, HRTF, dataset modification method, the method comprising:

identifying a first HRTF from an HRTF dataset and identifying a first virtual sound source location associated with the first HRTF;

generating a filter in dependence upon the first HRTF, wherein the generating comprises the steps of:

identifying a spectral response of the first HRTF, identifying one or more second HRTFs within the HRTF dataset, each such one or more second HRTFs being associated with a respective second virtual sound source location within a predetermined distance of the first virtual sound source location associated with the first HRTF, and a corresponding spectral response associated with each of the second HRTFs, generating an average of each of the identified spectral responses of the first and second HRTFs, and generating a filter using the inverse of this average; and modifying the first HRTF by applying the generated filter to the identified spectral response to generate an output HRTF.

12. The method of claim 11, further comprising:

identifying a contralateral response of each identified HRTF, and generating a representative response for the identified contralateral responses; and replacing the contralateral response of the first HRTF with the generated representative response.

13. The method of claim 11, wherein:

a process of (a) modifying ipsilateral responses of one or more HRTFs of a first HRTF dataset by carrying out actions, includes the identifying the first HRTF from the HRTF dataset, the generating the filter, and the modifying the first HRTF; and the process further includes (b) modifying contralateral responses of one or more HRTFs in the first HRTF dataset by carrying out actions, including:

(i) identifying a first HRTF from the first HRTF dataset and one or more additional HRTFs at a corresponding location in each of one or more additional HRTF datasets;

(ii) identifying a contralateral response of each identified HRTF, and generating a representative response for the identified contralateral responses; and (iii) replacing the contralateral response of the first HRTF with the generated representative response.

14. A non-transitory machine-readable storage medium which stores computer software which, when executed by a computer, causes the computer to perform a head-related transfer function, HRTF, dataset modification method comprising the steps of:

identifying a first HRTF from an HRTF dataset and identifying a first virtual sound source location associated with the first HRTF;

generating a filter in dependence upon the first HRTF, wherein the generating comprises the steps of:

identifying a spectral response of the first HRTF, identifying one or more second HRTFs within the HRTF dataset, each such one or more second HRTFs being associated with a respective second virtual sound source location within a predetermined distance of the first virtual sound source location associated with the first HRTF, and a corresponding spectral response associated with each of the second HRTFs, generating an average of each of the identified spectral responses of the first and second HRTFs, and generating a filter using the inverse of this average; and modifying the first HRTF by applying the generated filter to the identified spectral response to generate an output HRTF.

15. The non-transitory machine-readable storage medium of claim 14, further comprising the steps of:

identifying a contralateral response of each identified HRTF, and generating a representative response for the identified contralateral responses; and replacing the contralateral response of the first HRTF with the generated representative response.

* * * * *